US005814747A

United States Patent [19]

Ramsell

[11] Patent Number: 5,814,747

[45] Date of Patent: Sep. 29, 1998

[54] PERCUSSION INSTRUMENT CAPABLE OF PRODUCING A MUSICAL TONE

[76] Inventor: Craig Ramsell, 9 Edgewater Ct., San Rafael, Calif. 94903

[21] Appl. No.: 806,644

[22] Filed: Feb. 26, 1997

Related U.S. Application Data

[63] Continuation of Ser. No. 328,046, Oct. 24, 1994, abandoned.

[51] Int. Cl.[6] ..... G10D 13/08

[52] U.S. Cl. ..... 84/402; 84/422.4; 84/452 P; 84/349; 446/418

[58] Field of Search ..... 84/402, 403, 404, 84/406, 410, 422.4, 422.1, 452 R, 452 P, 349, 350; 446/418, 419, 421, 422

[56] References Cited

U.S. PATENT DOCUMENTS

| | | | |
|---|---|---|---|
| 568,816 | 10/1896 | Treat | 84/403 |
| 644,817 | 3/1900 | Deagan . | |
| 2,317,164 | 4/1943 | Zimmerman | 84/403 |
| 4,034,499 | 7/1977 | Wild | 46/52 |
| 4,165,671 | 8/1979 | DeBose | 84/402 |
| 4,269,104 | 5/1981 | Cantus, Jr. | 84/330 |
| 4,469,003 | 9/1984 | Phelps | 84/604 |
| 4,690,404 | 9/1987 | Yoder | 446/418 |
| 4,867,033 | 9/1989 | Shimoda et al. | 84/410 |
| 4,998,456 | 3/1991 | Matti | 84/452 P |
| 5,044,250 | 9/1991 | Beyer | 84/422.4 |
| 5,155,287 | 10/1992 | Mason | 84/410 |
| 5,219,163 | 6/1993 | Watson | 446/421 |
| 5,255,589 | 10/1993 | Caulkins | 84/330 |
| 5,272,951 | 12/1993 | Cohen | 84/402 |
| 5,323,678 | 6/1994 | Yould | 84/418 |

OTHER PUBLICATIONS

Musical Engineering, Harry F. Olson, 1952, pp. 76, 174–175.

Principles of Materials Science and Engineering, Wilham Smith, 1986, p. 327.

*Primary Examiner*—Cassandra C. Spyrou

*Attorney, Agent, or Firm*—Michael A. Glenn

[57] ABSTRACT

A percussion instrument made of durable synthetic tubing which is longitudinally rigid and radially flexible. The tubes are precisely tunable to specific musical pitches through combining proper diameters and lengths of the tubes. The sound is produced primarily by vibration of the column of air within and exiting the tube, which results from striking the tube with an object such as a mallet or from striking another object, including the human body, with the tube. The nature of the sound produced varies greatly with the resonant and textural qualities of the struck object. Accordingly, multi-textured percussion blocks are provided for striking with the tubes. In addition, a cap is provided for the end of the tube which will lower its pitch about one octave and which, when combined with a second cap, will create a cavity in which pellets, such as steel shot or dried beans, may be placed to produce a rattle.

14 Claims, 7 Drawing Sheets

PERCUSSION INSTRUMENT CAPABLE OF PRODUCING A MUSICAL TONE

This is a continuation of application Ser. No. 08/328,046 filed Oct. 24 1994 now abandoned.

BACKGROUND OF THE INVENTION

1. Technical Field

This invention relates to musical instruments and musical toys, specifically to a new use of synthetic tubing as a percussion instrument or toy.

2. Description of the Prior Art

Knowledge of the ability of tubes of various materials to produce percussive sounds and musical tones goes back to ancient cultures. These sounds have been produced in a variety of ways, most notably by striking the tubes, as in hollow wooden logs and more recently chimes, and by blowing through or across an opening in the tubes, as in the category of wind instruments. It is also well known that vibrating materials of differing lengths and thicknesses, or in the case of tubes, differing diameters, will produce different musical tones. Tubes of various materials have also been used to enhance the percussive resonance of other instruments, as in marimbas, vibraphones and, in U.S. Pat. No. 4,867,033, an idiophone, such as a clave.

The importance of maintaining structural rigidity in the interior wall of the wind instrument for producing its sound is emphasized in U.S. Pat. No. 4,998,456 to Matti, which uses a synthetic material, an epoxy plastic reinforced with carbon fibers, in the construction of a flute. Similarly, in U.S. Pat. No. 5,255,589, Caulkins claims the use of a very rigid synthetic material, polyvinyl chloride pipe, in the construction of a calliope, which uses pressurized air to produce its sound. In U.S. Pat. No. 4,034,499, which is classified as a toy, the inventor Wild claims a tone generator comprised of a flexible, semirigid material in the form of a hollow tube which is open at both ends and which has ridges within the tube that produce a musical tone in response to the passage of air through the tube created by swinging the tube through the air.

The remaining prior art discussion focuses on percussion instruments, i.e. instruments that are beat or struck. Drums in the form of membranophones, which may or may not be tunable, have existed for centuries in many cultures. Historically, these instruments have been made of natural materials. The bodies of some generally tubular drums have been made with synthetic materials, and several U.S. patents have been granted to such drums, including No. 3,867,863 to Vennola, No. 4,026,185 to Migirian, and Nos. 4,045,264 and 4,091,706 to Ludwig. All of these inventions utilize a membrane as a drum head, and the membrane is struck for the drum to produce its characteristic sound.

Outside the category of membranophones, Deagan, in U.S. Pat. No. 644,817, states that the embodiment of his invention has come to be termed the "aluminum chimes". Deagan discloses a preferred embodiment comprised of cold-drawn steel tubing "although various classes of materials possessing the proper qualities of resonance may be employed," a plurality of musical tubes and a framework for mounting the tubes into a musical instrument. In his U.S. Pat. No. 1,100,671, Deagan's metal tubes are suspended from a top rail. In each of these cases the tubes are designed to be struck, but not to be held by hand to produce their sounds by striking other objects. In fact, holding such tubes would prevent them from vibrating.

In U.S. Pat. No. 4,469,003, Phelps teaches the addition of striker elements in a framework of musical tubes, such elements designed to strike the tubes to produce their characteristic sounds when the entire frame is held and moved. Phelps again uses metal tubes within a frame although it can be hand-held.

There are a number of patented percussion instruments involving tubes that use or anticipate the use of synthetic material for the majority of their construction. U.S. Pat. Nos. 4,165,671 to De Bose and 5,323,678 to Yould describe shakers wherein rattle members are contained within tubes to produce sound when shaken. A similar concept is employed in U.S. Pat. No. 5,044,250 to Beyer in which the rattle members are contained in a single closed linear tube that can be used as a drumstick that also rattles. In U.S. Pat. No. 5,272,951 to Cohen, a beaded net is attached to the outside of a hollow tube that may be made of plastic. Although these shaker-type inventions are designed to be hand-held, their percussive effect is produced either by the enclosed rattle members striking the inner walls or the beads of the net striking the outer wall of the tubes when they are set in motion.

In U.S. Pat. No. 4,898,061 to Mason, a percussion rhythm apparatus is claimed, which uses hollow tubular members which may be made of plastic. In Mason's apparatus, two hollow tubes laterally extend from a base member to which they are attached in a pivotal manner. These tubes may be struck against each other or the floor in a manner to produce a rhythmic effect.

There is no indication given that the tubes in any of these percussion inventions are meant to produce a measurable musical pitch, and it is unlikely by their nature that such pitch would result from their use. None of these instruments are designed to produce their sound by striking other objects, including the human body.

SUMMARY OF THE INVENTION

The invention provides a percussion instrument made of durable synthetic tubing which can be either extruded and cut or molded and which is longitudinally rigid and radially flexible. The longitudinal rigidity is important to the production of a measurable musical tone while the radial flexibility is important in exciting the air space within the tube to produce the sound waves that result in the desired tone. The radial flexibility is also important in providing the ability of the tubes to strike a wide variety of objects without damaging the tubes or the struck object. The tubes are precisely tunable to specific musical pitches through combining proper diameters and lengths of the tubes. As a result, they can function as harmonic and melodic musical instruments, in addition to more harmonious rhythmic instruments, a combination which few percussion instruments achieve.

The sound is produced primarily by vibration of the column of air within and exiting the tube, which results from an impact between the tube and another object, such as the human body, a table, a mallet or another tube. The nature of the sound produced varies greatly with the resonant and textural qualities of the struck object. Accordingly, multi-textured percussion blocks are provided for striking with the tubes and result in the ability to quickly achieve a wide variety of different sounds with the tubes.

The tubes are very versatile in the many means in which they may be played. These means include: 1) a tube or a pair of tubes may be held like drumsticks, striking another object, which may be stationary or moving, and which includes the human body or another such tube; 2) a tube may be played by striking with a mallet or similar object while the tube remains stationary, including holding in the hand with the focus of movement being the striking object rather than the tube; and 3) a series of tubes may be temporarily stabilized side-by-side in a particular sequence on a platform to produce an instrument to be played by striking the tubes thereon with other objects, such as mallets, which instrument has a pleasing musical combination and may include a variety of possible musical scales of a full octave or more.

With attention to the proper diameters, the tubes may be placed one partially within another by varying amounts of overlap to create a combination that can produce a wide variety of notes. In addition, a cap is provided for the end of the tube which will lower its pitch precisely one octave and which, when combined with a second cap, will create a cavity in which pellets, such as steel shot or dried beans, may be placed to produce a rattle.

Because the tubes are musical, inexpensive and fun to play, they may readily function as a musical toy and be an important new tool in teaching children rhythm and music. Their light weight and compact size makes them very portable and easy to use, and their excellent reflectivity creates interesting visual effects when used in the colored-light environment of a typical stage performance.

The invention relies upon a vibrating column of air moving through the instrument as the primary source of sound emanating from the tube, with the material of the tube adding timbre to the sound. The air is set into motion in the present invention by percussive means.

DETAILED DESCRIPTION OF THE PREFERRED EMBODIMENT

Figure 1:
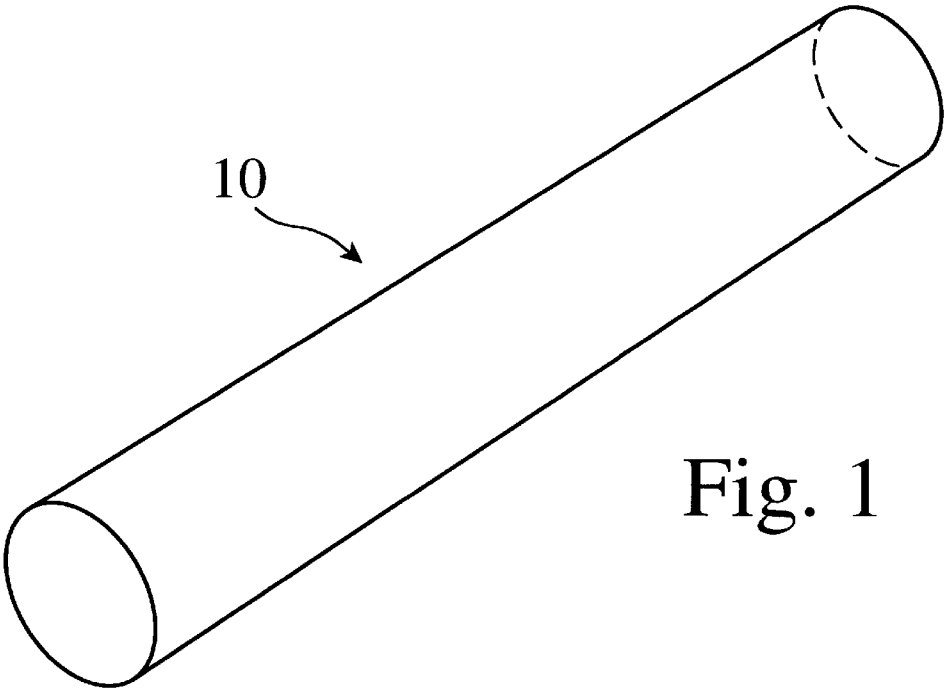
FIG. 1 is a perspective view of a synthetic percussion tube.
Figure 2:
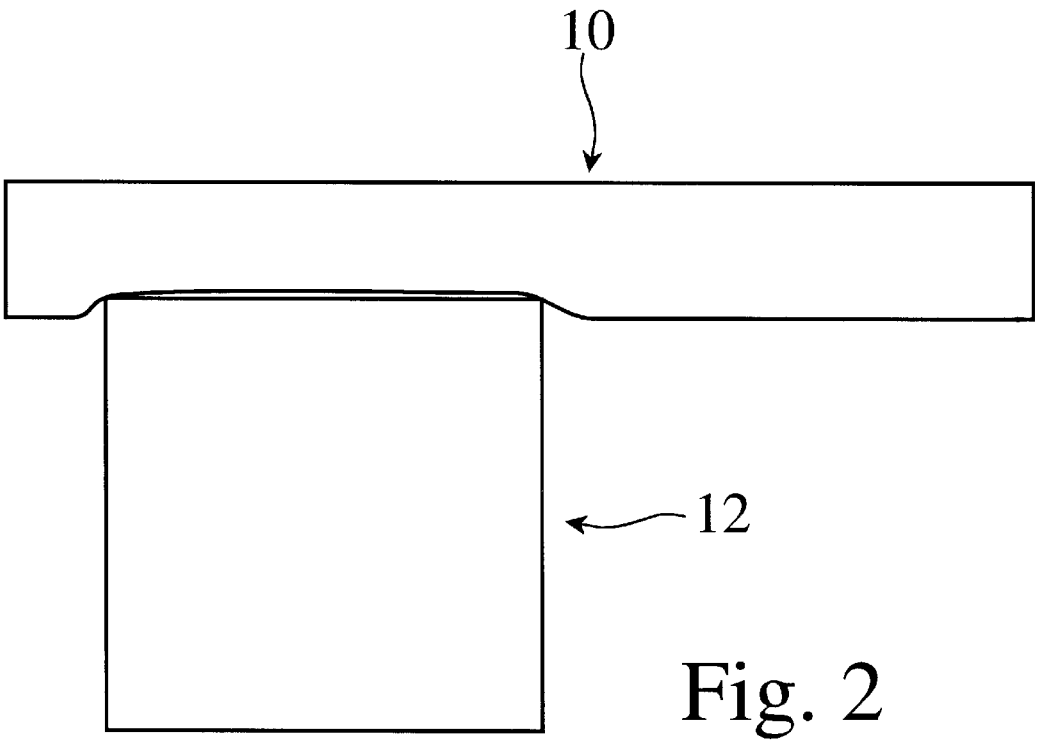
FIG. 2 shows a side view of a synthetic percussion tube at the moment of striking a square object, demonstrating the radial flexibility and longitudinal rigidity of the tubing.

FIG. 1 is a perspective view of a synthetic percussion tube 10. Tube 10 is made from a durable synthetic material that can be either extruded and cut or molded. Tube 10 requires the combined properties of longitudinal rigidity with radial flexibility as illustrated in FIG. 2, which shows a side view of tube 10 at the moment of striking a square struck object 12, demonstrating the radial flexibility of the tubing, while the majority of the circumferential wall of tube 10 remains rigid along its primary axis. The longitudinal rigidity is important to the production of a measurable musical tone while the radial flexibility is important in exciting the air space within tube 10 to produce the sound waves that result in the desired tone. The radial flexibility is also important in providing the ability of tube 10 to strike a wide variety of objects without damaging the tube 10 or the struck object. It is the vibration of the column of air within tube 10 that is primarily responsible for the musical sound produced, with the dimensions of that column affecting the pitch of the sound. The body of tube 10 and its impact with a striking or struck object affect the timbre of the sound.

Examples of materials that have been presently identified that meet the above criteria are cellulose acetate butyrate (C.A.B.) tubing, polyethylene tubing, and polycarbonate tubing, at least at thinner wall thicknesses. Tubes 10 made of C.A.B. tubing of a variety of lengths and diameters have been produced, with many such tubes cut to precise lengths to create specific musical pitches, such as C, C#, D, etc. For purposes of tone production and ease of holding, a range of diameters of 1½" to 2½" and range of lengths from approximately 10" for smaller diameters to 4" or more for larger diameters are most effective, with larger diameters required for longer lengths and smaller diameters required for shorter lengths for the most resonant sound production.

Wall thickness of the tubing is also important. Too thick a wall will sacrifice radial flexibility. Too thin a wall will result in the loss of longitudinal rigidity at typical impact forces. Either event will seriously deteriorate the optimal sound production. A suitable wall thickness for C.A.B. tubing is about 0.020" to 0.032".

Tube 10 follows the musical principles of vibrating air columns. It has an effective length of air flow that is a function of a factor (equal to approximately 0.61) times its diameter added to its length, when open at both ends. When a specific length is determined for the pitch of middle C, for instance, the remaining pitches of a tempered chromatic scale can be calculated by using the inverse of the ratio of the frequency of the tempered pitch to middle C. The following is a table of calculations for a chromatic scale of tubes 10 using C.A.B. tubing with an inside diameter (i.d.) of 36 mm and a 1/32" wall:

| Pitch | Ratio | Inverse | Effective Length | End Adj.* | Actual Length |
|---|---|---|---|---|---|
| C | 1.000 | 1.0000 | 656.0 mm | 22.0 mm | 634.0 mm |
| C# | 1.059 | .9443 | 619.5 | " | 597.5 |
| D | 1.112 | .8913 | 584.7 | " | 562.7 |
| D# | 1.189 | .8410 | 551.7 | " | 529.7 |
| E | 1.260 | .7937 | 520.6 | " | 498.6 |
| F | 1.335 | .7491 | 491.4 | " | 469.4 |
| F# | 1.414 | .7072 | 463.9 | " | 441.9 |
| G | 1.498 | .6676 | 437.9 | " | 415.9 |

-continued

| Pitch | Ratio | Inverse | Effective Length | End Adj.* | Actual Length |
|---|---|---|---|---|---|
| G# | 1.587 | .6301 | 413.4 | " | 391.4 |
| A | 1.682 | .5945 | 390.0 | " | 368.0 |
| A# | 1.782 | .5612 | 368.1 | " | 346.1 |
| B | 1.888 | .5297 | 347.5 | " | 325.5 |
| C' | 2.000 | .5000 | 328.0 | " | 306.0 |

*End Adjustment for tube open at both ends equals .61 * 36 mm i.d. = 22.0 mm

The actual length of tube 10 made of the above described C.A.B. tubing for a pitch of middle C was first determined by trial and error using an inexpensive digital tuner, measuring as accurately as possible using such tuner in a typical indoor ambient room temperature. The effective length was then determined by adding the end adjustment. The effective length was then multiplied by the inverse of the frequency ratio of the desired pitch to determine the effective length of tube 10 for that pitch. Finally, the end adjustment was subtracted from the effective length to determine the required actual length for the new pitch. The new tube was then cut, and the effectiveness of the calculation and cutting of the C.A.B. tubing was verified using the digital tuner. The pitches are affected by temperature changes. The above calculations are representative and subject to verification and refinement. An example of another middle C combination of length and diameter for 1/32" wall C.A.B. tubing is 50 mm inside diameter and actual length of 629 mm.

Commercial suppliers of extruded C.A.B. tubing typically cannot cut the tubing during the extrusion process with the necessary accuracy to ensure a precise pitch, so a second step with a finisher is required. C.A.B. tubing is normally a clear, almost transparent material. However, it can be tinted almost any color and its transparency can be reduced to the point the tubing is opaque. The amount of plasticizer used in C.A.B. can also vary and higher than average amounts of plasticizer may assist in reducing stress fractures that occur when a tube 10 is struck on its edge. There is an interactive effect between the amount of plasticizer in the C.A.B. and the wall thickness required to maintain proper longitudinal rigidity at typical impact forces.

Figure 3:
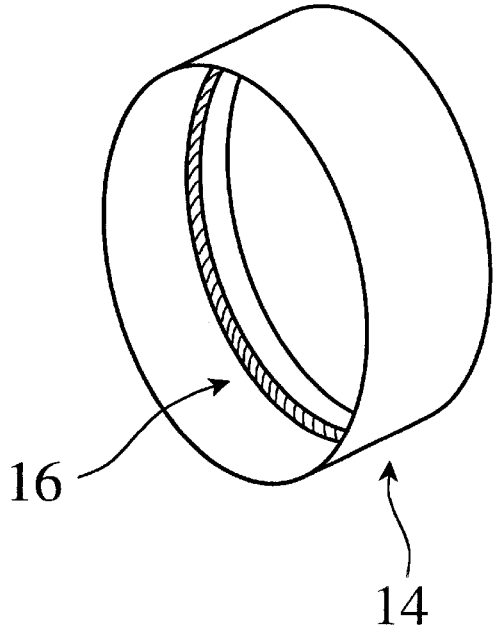
FIG. 3 is a perspective view of an enlarged end cap.
Figure 4:
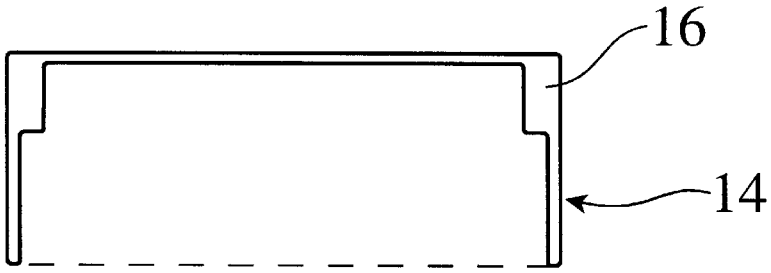
FIG. 4 is a cross-sectional side view of such end cap.

FIG. 3 is a perspective view of an enlarged end cap 14 to be used in conjunction with tube 10. FIG. 4 is a cross-sectional side view of such cap, showing a ridge 16 which circumnavigates the inner circumference of cap 14. The inner diameter of cap 14 is equal to the outer diameter of tube 10, with the exception of ridge 16 which protrudes from the inner wall of cap 14 preferably by an amount equal to the wall thickness of tube 10. Ridge 16 protrudes from the closed end of cap 14 by an amount which is a function of the diameter of tube 10.

Figure 5:
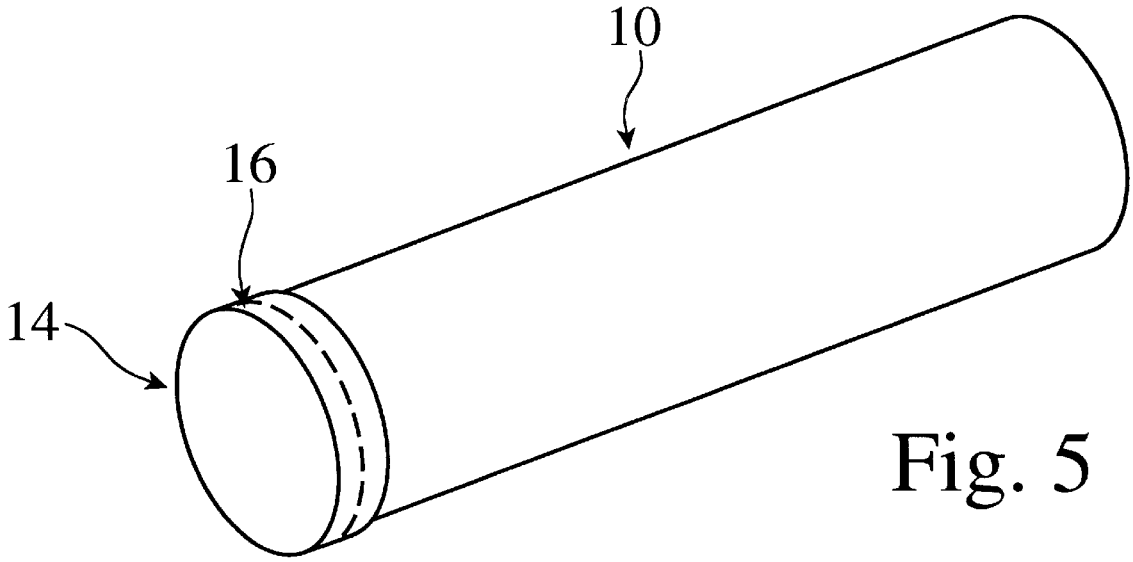
FIG. 5 shows a perspective view of a synthetic percussion tube with end cap in place on the end of the tube.

FIG. 5 shows a perspective view of tube 10 with end cap 14 in place on the end of tube 10. When cap 14 is pressed on the end of tube 10 flush to ridge 16, the musical pitch of tube 10 is lowered by precisely one octave. Cap 14 is held in place by friction between its inner wall and the outer wall of tube 10. A suitable material for cap 14 is polyethylene.

Figure 6:
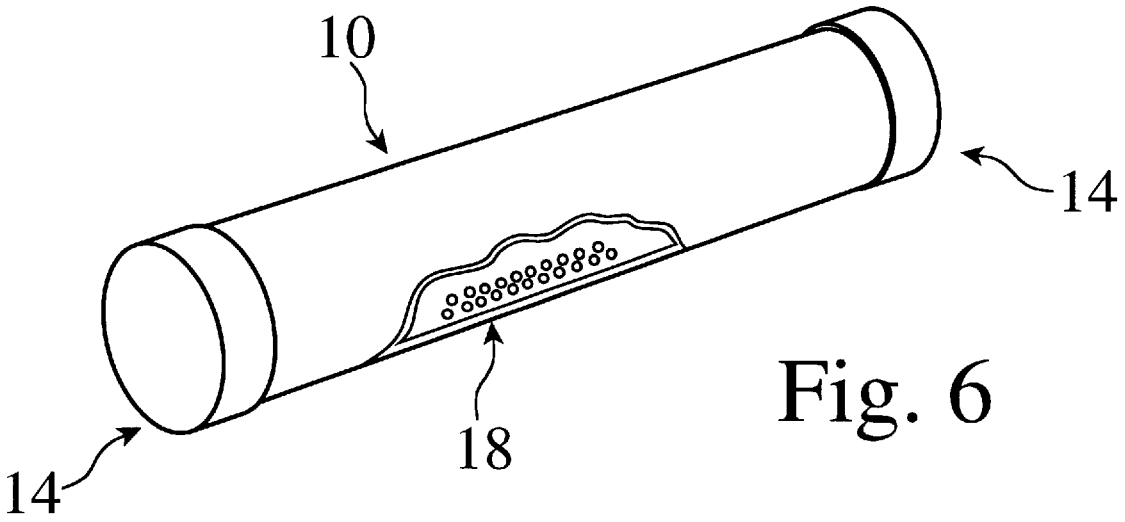
FIG. 6 is a perspective view of such a tube with an end cap on each end and a plurality of pellets within the tube.

FIG. 6 is a perspective view of tube 10 with a cap 14 on each end and a plurality of pellets 18 within tube 10, which can function as a shaker-type rattle percussion instrument. Any number of materials are suitable as pellets 18, so long as they are reasonably small, e.g. 1/8" to 3/8" diameter, and hard. Example pellets 18 are steel shot, dried beans or lentils, and unpopped popping corn. The sound of pellets 18 striking the inner wall of the cavity 20 formed by tube 10 and caps 14, when shaken, varies considerably depending on the material used for pellets 18.

Figure 7:
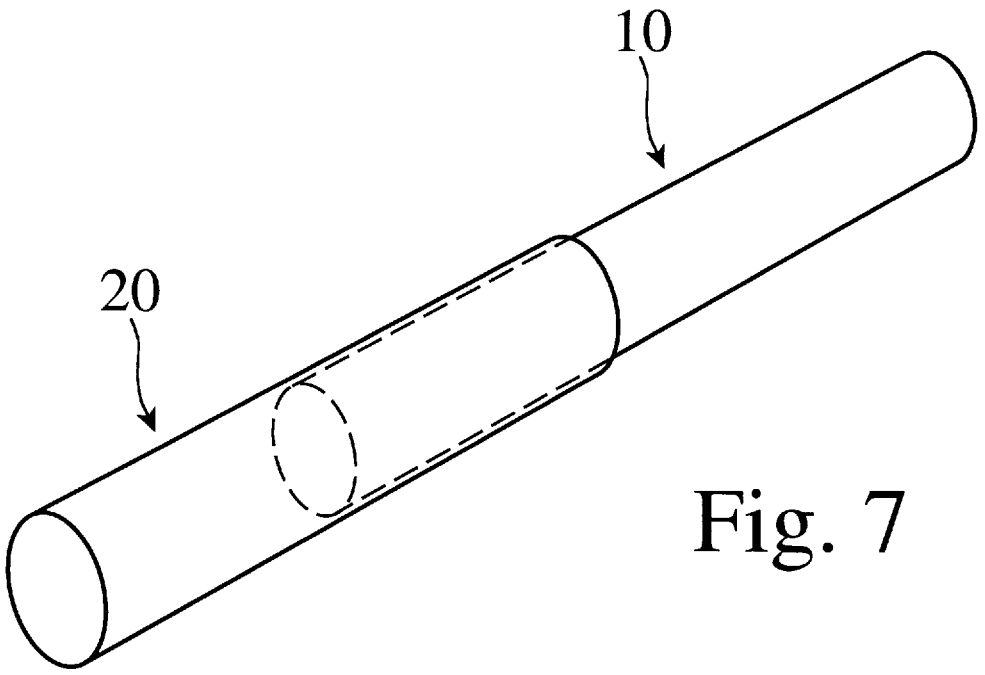
FIG. 7 is a perspective view of two synthetic percussion tubes, one lying partially within the other.

FIG. 7 is a perspective view of tube 10 lying partially within a larger diameter tube 20, which has an inner diameter equal to or slightly larger than the outer diameter of tube 10. Tube 10 can be slipped inside tube 20 by varying amounts and held in place by hand-applied pressure on tube 20 or by friction between the respective overlapping surfaces of such tubes. Markings may be placed on the circumference of larger diameter tube 20 to show positions at which to place the end of tube 10 within tube 20 to produce specific musical pitches that are a result of the combined length of the two tubes.

Figure 8:
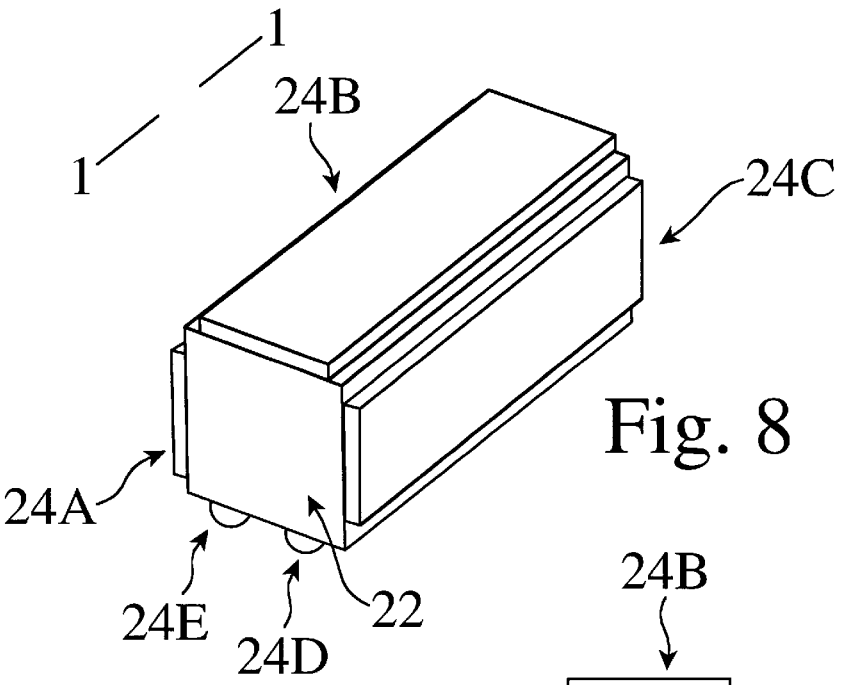
FIG. 8 is a perspective view of a percussion block with materials of different textures affixed to four of the six sides.

Striking objects of different materials with tube 10 can result in very different timbres. FIG. 8 is a perspective view of a percussion block 22 with materials of different textures affixed to four of the six sides. Block 22 provides a convenient means for providing these different textures and their concomitant sounds on one striking object. Block 22 may be made of wood or any suitable, dense material. A good size for block 22 is approximately 4" in height and depth and 10"–12" in length.

Material 24A, material 24B, material 24C, material 24D and material 24E in FIG. 8 represent example materials of differing textures that may be attached to block 22 with different means, such as permanent adhesives, nails, screws, and magnets. Sample materials 24A–E are short-pile carpet, tire rubber, dense foam rubber, various plastics and wood strips or molding. Materials 24D and 24E may be the same material or a different material.

Figure 9:
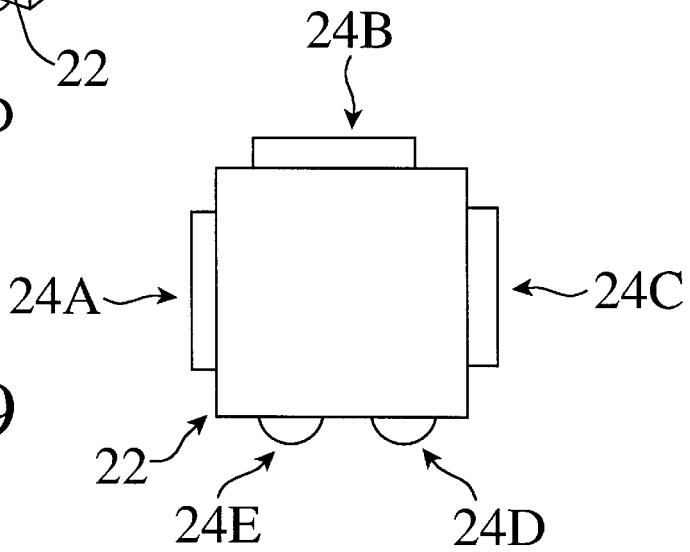
FIG. 9 shows the block of FIG. 8 as viewed from its end.

FIG. 9 shows block 22 as viewed from its end and shows that materials 24D and 24E are constructed and positioned to provide a stable base for block 22 when they are on the bottom. The construction and positioning of each of materials 24A–E must provide for this stability, so that block 22 does not move unnecessarily when struck from above by tube 10.

Figure 10:
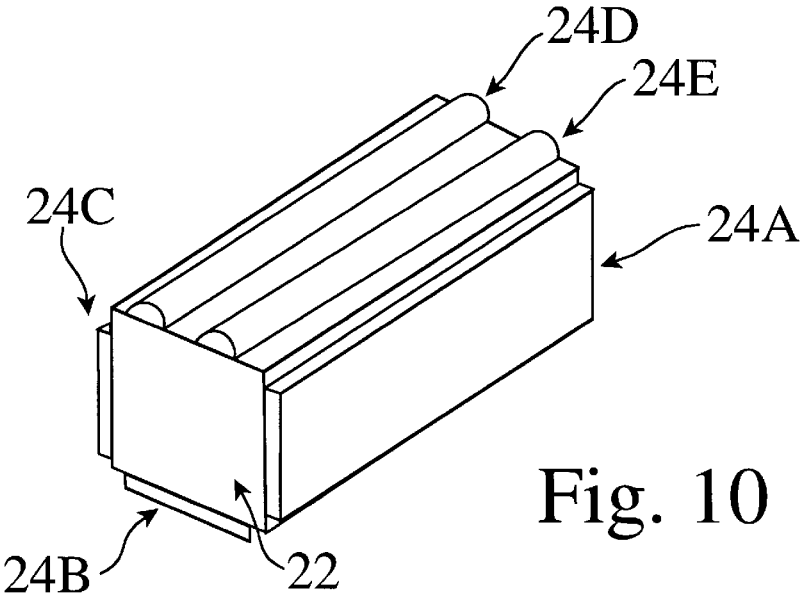
FIG. 10 is a perspective view of such block rotated 180 degrees along the axis defined by line 1—1 in FIG. 8.
Figure 11:
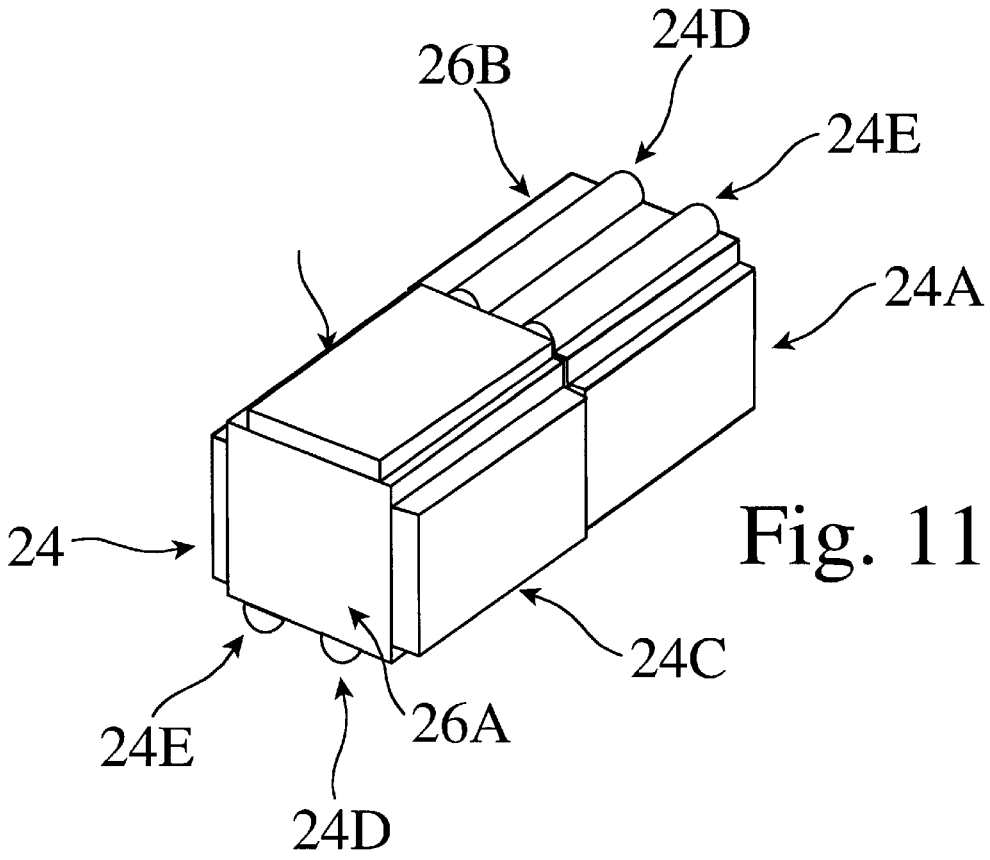
FIG. 11 is a perspective view of a block similar to that of FIG. 8, which has been cut in half and connected by a pin along the axis of line 1—1 in FIG. 8 in the center of the two portions, and which has the rear portion rotated 180 degrees about the pin to a position comparable to that shown in FIG. 10.

FIG. 10 is a perspective view of block 22 rotated 180 degrees along the axis defined by line 1—1 in FIG. 8. FIG. 11 is a perspective view of a block similar to that of FIG. 8, which has been cut in half, forming split block portion 26A and split block portion 26B, and which is connected by a pin 28 (shown in FIG. 12) along the axis of line 1—1 in FIG. 8 in the center of the two portions 26A and 26B, and which has portion 26B rotated 180 degrees about pin 28 to a position comparable to that shown in FIG. 10.

Figure 12:
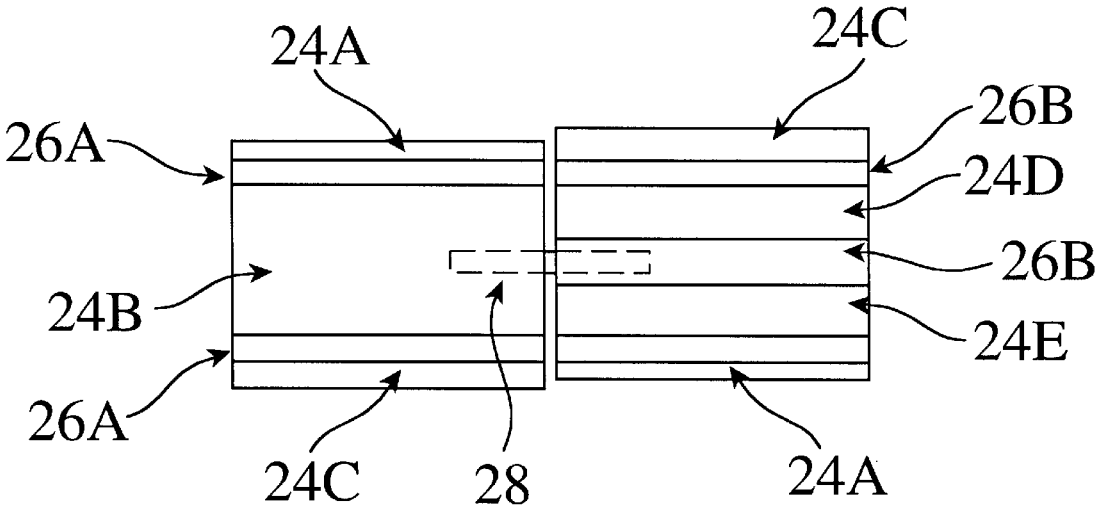
FIG. 12 is a top view of the block shown in FIG. 11 which shows the position of the pin from that perspective.

FIG. 12 is a top view of the block shown in FIG. 11, which shows the position of pin 28 from that perspective. By providing the ability to rotate different portions of the block relative to one another, a wider variety of textures may be simultaneously present on the top plane and struck in quick succession for more interesting percussive effect. Although only two such portions are illustrated, three or more could be similarly combined for an even greater array of textured material 24A–E to be simultaneously on the top plane for striking with tube 10.

Figure 13:
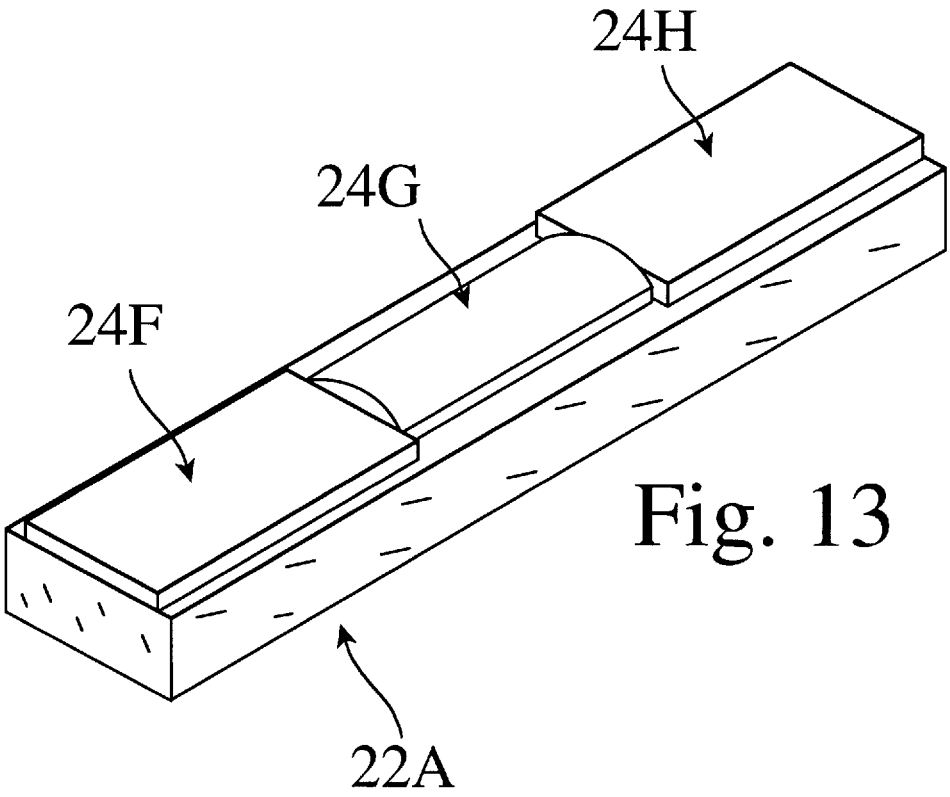
FIG. 13 is a perspective view of a block of greater length and less depth than the previously shown blocks with several different textures affixed to the top face.

FIG. 13 is a perspective view of a block 22A of greater length and less depth than block 22 with several different textures affixed to the top face, materials 24F, 24G and 24H. While preferably longer than block 22 and potentially greater in weight, both of which factors reduce portability, block 22A can supply a greater number of such materials on one plane with simpler construction than block 22. Additionally, there is no need to require materials 24F–G to present a flat surface with block 22A because it is not designed to be rotated, unlike block 22. Block 22A can also be constructed of any suitable material. Materials 24F–G can be any of the types of materials listed for materials 24A–E and attached in the same manner. Although three materials are illustrated on the top face of block 22A, more can be present.

Tube 10 (FIG. 1) is a percussion instrument which is more versatile than the prior art in the wide variety of means in which it may be played. These means include: 1) tube 10 or a pair of such tubes may be held like drumsticks, striking another object, which may be stationary (such as blocks 22 (FIG. 8) or 22A (FIG. 13) and as illustrated in FIG. 2) or moving, and which includes the human body or another such tube, to produce a) the tone of tube 10, b) a timbre which varies greatly with the nature of the struck object (such as materials 24A–H shown in FIG. 8) and c) the musical sound of the struck object (such as another tube 10), if any; 2) tube 10 may be played by striking with a mallet or similar object while tube 10 remains stationary, including holding in the hand with the focus of movement being the striking object rather than the tube; and 3) a series of tubes 10 may be temporarily stabilized side-by-side in a particular sequence on a platform to produce an instrument to be played by striking the tubes 10 thereon with other objects, such as mallets, which instrument has a pleasing musical combination and may include a variety of possible musical scales of a full octave or more.

Because of the above variety of methods for playing tube 10, and the ability of such tube to be precisely tuned, a series of such tubes can function musically as rhythmic, harmonic or melodic instruments and can be performed with other instruments in a harmonious manner. A large variety of objects, such as furniture, rails, posts, floors, etc., can be struck by the tube 10 with reasonable force without damaging either such tube or the struck object. The nature of the sound produced will vary greatly with the resonant nature of the struck object, but the pitch will always sound (as long as the struck object is not too soft). A pair of differently pitched tubes can be struck against each other to create a two-note interval. Tube 10 is pliable enough that many parts of the human body can be struck repeatedly with moderate force without bruising the body tissue. The thick muscles of the front of the thigh are particularly suited to good sound production. Even the top of the head can be struck without deleterious effects.

When held by hand, it is preferable to hold tube 10 close to one end, without blocking the air flow exiting that end. The optimal resonance of sound produced by tube 10 held in this manner occurs when such tube strikes (or is struck by) another suitable object at a position roughly one third the length of such tube from its opposite end. If such tube is being supported in the manner described in point 3 above, the optimal position for striking such tube is at the middle of its longitudinal axis. Once again, care should be taken not to block the exiting air from the ends of such tube, as it will affect either or both of the pitch and the sonority. In all cases the volume of the sound produced is a function of the force of collision between tube 10 and the struck object and of the resonance of the struck object. For instance, striking a carpeted floor with tube 10 will produce a much louder sound than striking a piece of similar carpet affixed to block 22.

Because tube 10 is both durable and at the same time pliable, a large number of objects, including various parts of the human body, may be struck by the instrument for musical or humorous effect, without damaging the struck objects or the instrument. Due to the relatively low production cost of tube 10 in its preferred embodiment and the amusing ways in which it can be played, it can function as a musical toy in addition to a musical instrument. These qualities also make tube 10 a unique and attractive tool for teaching children in the art of rhythm and music.

The highly reflective surface of tube 10 provides for an attractive visual effect when used in a typical professional performance that utilizes a variety of colored lights shining on the stage. Additionally, the light weight and compact size of tube 10 makes it conveniently portable.

Block 22 in FIG. 8 with its alternative configuration in FIGS. 11 and 12 and block 22A in FIG. 13 all operate with tube 10 in a similar manner. They are positioned on a stable surface, such as a floor or table, and struck from above with one or more tubes 10. The variety of textured striking surfaces provided by materials 24A–H can result in substantially different timbres of sounds, which when combined with tubes 10 of same or different pitches provides for a large array of musical sounds.

Cap 14 (FIGS. 3 and 4) performs two functions. Placed on one end of tube 10 so that ridge 16 is flush with the end of such tube, as illustrated in FIG. 5, the pitch of such tube is reduced by about one octave. As shown in FIG. 6, a plurality of pellets 18 may be inserted in the cavity created by placing two caps 14 on tube 10, one at each end. Shaking tube 10 in this configuration in a rhythmic manner produces a pleasing rattle sound. The timbre of this sound is dependent on the material used for pellets 18. When cap 14 is placed over the end of tube 10 flush with ridge 16, it is held by friction, and there is little risk of cap 14 falling off and spilling pellets 18.

When tube 10 and larger diameter tube 20 are used as shown in FIG. 7, the pitch produced by the combination is a function of the combined length of the two tubes, and to a very small degree, of the slightly larger diameter of tube 20. If the inner diameter of tube 20 is equal to just slightly more than the outer diameter of tube 10, the two tubes will maintain their position relative to one another by friction. If the inner diameter of tube 20 is slightly larger still, some pressure will be required to be applied on tube 20 against the intersecting portion of tube 10 in order for the relative positions to be maintained, but it will be easier to move tube 10 back and forth within tube 20. As previously mentioned, markings around the circumference of tube 20 can be positioned as reference points at which to place the end of tube 10 for specific pitch adjustments. If desired, the tubes may be made of different materials, such that each tube has a unique tonal quality or voice.

Figure 14:
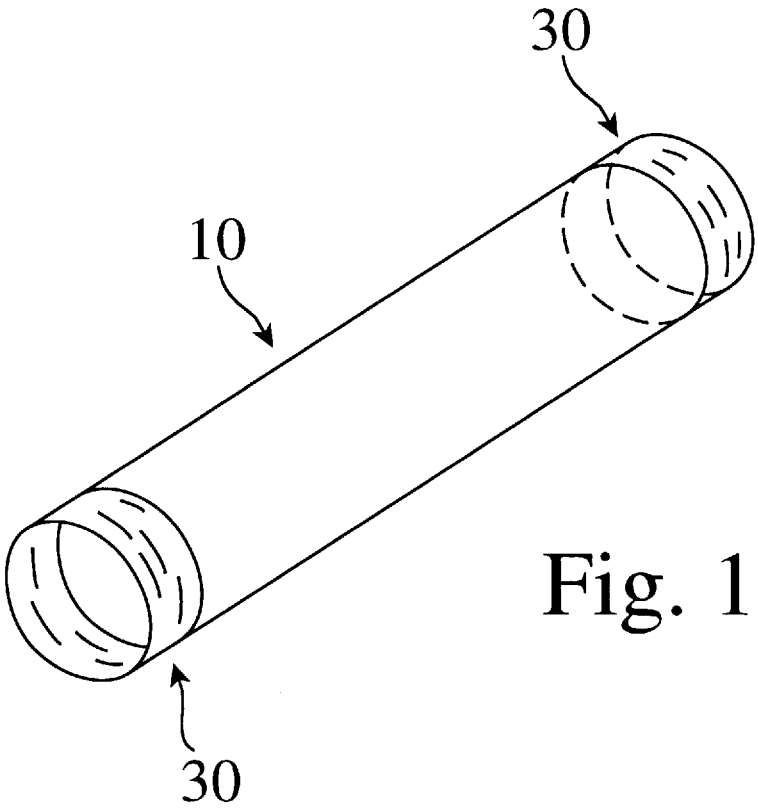
FIG. 14 is a perspective view of the tube of FIG. 1 showing the ends reinforced with a resin or laminate.

In the event that higher levels of plasticizer do not adequately eliminate the likelihood of stress fractures when tube 10 is struck too forcefully on its edge, it is possible to reinforce those edges. FIG. 14 is a perspective view of the tube of FIG. 1 showing a tube end 30 reinforced with a resin or laminate. The nature of this resin or laminate is to provide enough additional strength to the edges of tube 10 to prevent stress fractures when the edges are struck against another object. Ideally the reinforcement resin or laminate provides the necessary strength while minimally affecting the pliability of tube 10 at its edge. Otherwise, if tube end 30 becomes harder, there will be increased risk of damaging a struck object. Tube 10 with reinforced tube end 30 functions in an identical manner to tube 10 without such reinforcement, with due care for the possible increased hardness of tube end 30.

Figure 15:
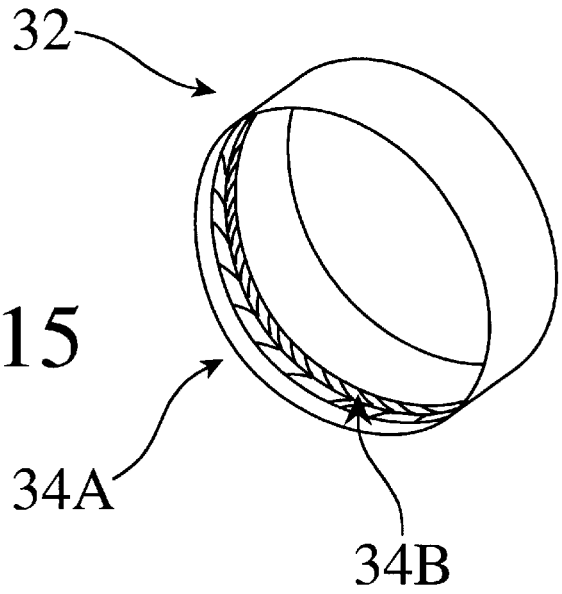
FIG. 15 is a perspective view of an enlarged end reinforcer for use with the tube of FIG. 1.

FIG. 15 is a perspective view of an enlarged end reinforcer 32 for use with the tube 10, which provides an alternative means for reinforcing the edge of such tube. Reinforcer 32 is a separate device designed to be positioned on the edge of tube 10 to provide any necessary protection from stress fracture at such edge. Unlike cap 14, reinforcer 32 keeps tube 10 open at its end, seating flush with the outer and inner surfaces of such end with outer lip 34A and inner lip 34B, respectively.

Figure 16:
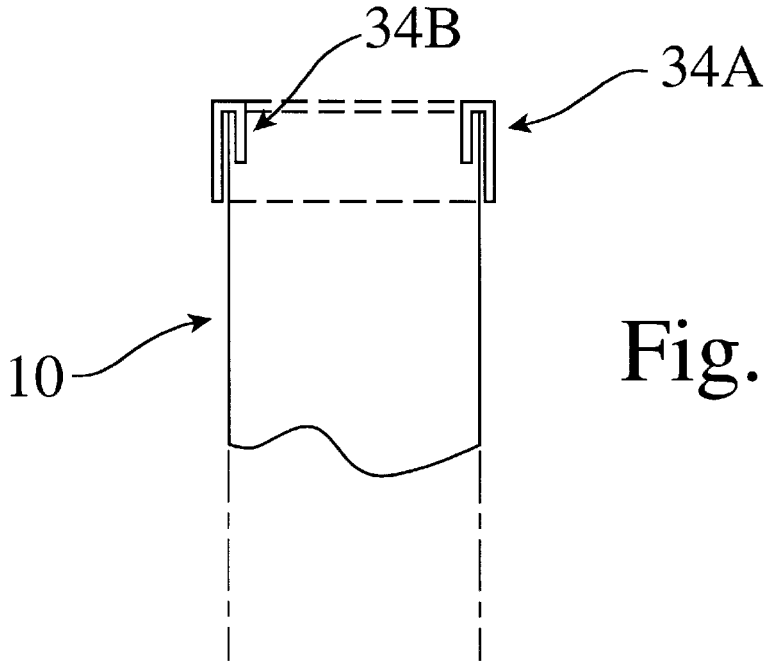
FIG. 16 is a cross-sectional side view of the end reinforcer of FIG. 15 in position at the end of such tube.
Figure 17:
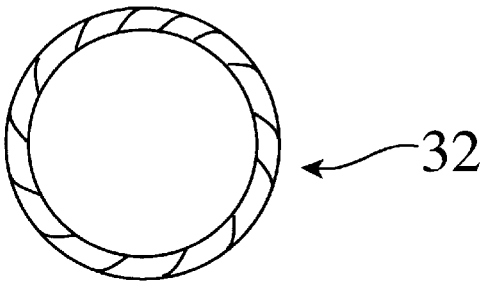
FIG. 17 shows a top view of the end reinforcer of FIG. 15.

FIG. 16 is a cross-sectional side view of reinforcer 32 in position at the end of tube 10, showing more clearly the position of such reinforcer. FIG. 17 shows a top view of such end reinforcer and the hollow space within its inner diameter. Reinforcer 32 may be made of molded polyethylene.

Tube 10 will function in its normal manner with reinforcer 32, except that due care must be given to the additional hardness of such reinforcer when striking objects with tube 10. In addition the invasion of reinforcer 32 into the inner air space of tube 10 will slightly lower the pitch of such tube. This effect could require the length of tube 10 to be reduced slightly for use with reinforcer 32 in order to achieve a correct pitch.

Therefore it can be seen that, according to the invention, I have provided a uniquely versatile, durable, and inexpensive percussion musical instrument that is very different than any of the prior art. Because they can be precisely tuned by constructing them with the proper combination of diameter and length, they can function as harmonic and melodic musical instruments, in addition to more harmonious rhythmic instruments, a combination which few percussion instruments achieve. It is a unique result of the combined properties of longitudinal rigidity and radial flexibility of the synthetic tubing that a measurable pitch can be achieved.

Because the synthetic percussion tubes are musical, inexpensive and fun to play, they may readily function as a musical toy and be an important new tool in teaching children rhythm and music. Their light weight and compact size makes them very portable and easy to use, and their excellent reflectivity creates interesting visual effects when used in the colored-light environment of a typical stage performance.

The versatility of the percussion tubes lies in the many ways in which they may be played. While many percussion instruments, such as a variety of hand drums, are designed to be struck by the human body, especially the hands, few percussion instruments are successfully performed by striking the human body, as are the percussion tubes.

In fact a large variety of objects, such as furniture, rails, posts, floors, etc., can be struck by the tubes with reasonable force without damaging either the tubes or the struck object. The nature of the sound produced will vary greatly with the resonant nature of the struck object, but the pitch will always sound (as long as the struck object is not too soft). A pair of differently pitched tubes can be struck against each other to create a two-note chord. Also, they may be played by striking with mallets, drumsticks or similar objects, either hand-held or arrayed in a framework containing a series of tubes of different pitches. With attention to the proper diameters, they may be placed one partially within another by varying amounts of overlap to create a combination that can produce a wide variety of notes.

The specially designed end caps yield additional versatility by making two notes possible with each tube, one note about one octave lower than the other, and by combining pellets within a double-capped tube to produce a rattle percussion instrument. The multi-textured percussion blocks provide a convenient way to quickly achieve a wide variety of different sounds with the percussion tubes.

Although the description above contains many specificities, these should not be construed as limiting the scope of the invention but as merely providing illustrations of some of the presently preferred embodiments of this invention. Various other embodiments and ramifications are possible within its scope. For example, other synthetic materials may be identified which will be less expensive, more durable and so on. Holes can be positioned along the tubes to produce a variety of pitches from one tube, much as it is done for a flute. Specific ways to temporarily mount the tubes in a series on a platform can be created with minimal degradation of their resonance. They may be suspended from a framework or otherwise mounted in a vertical fashion for striking with an object such as a mallet. End caps can be created with various amounts of material removed from the plane that caps the tube to produce changes in pitch. For example, an additional function of the cap 14 is to act as a membrane for the tube 10, which membrane may be struck to produce the musical tone of the tube 10 with a different timbre.

A variety of modifications are possible to the multi-textured percussion blocks, including different shapes, adding hinges to the longer blocks to make them more portable. Furthermore, the tube from which the instrument is fashioned may itself produce a musical tone at the same or different pitch as that of the column of air expelled from said tube, such that two musical notes having different tonal qualities and/or pitches may be produced at the same time.

Another embodiment of the instrument affixes a permanent or removable snare apparatus to the tube 10, as is done with a typical snare drum, which snare produces a vibrating sound against the surface of the tube 10 when the tube 10 is played.

Thus the scope of the invention should be determined by the appended claims and their legal equivalents, rather than by the examples given.

I claim:

1. A method of producing a desired musical tone, comprising the steps of:

providing a tube made of a synthetic material tuned to the desired musical tone;

said tube having two open ends and surrounding an internal column of air;

said tube having a thickness sufficient to render said tube radially flexible;

striking said tube against a surface imparting mechanical energy to the column of air to vibrate to produce sound waves that result in said desired musical tone.

2. The method of claim 1, wherein said tube is longitudinally rigid.

3. The method of claim 1, wherein at least one of said two open ends of said tube is reinforced.

4. The method of claim 1, wherein said striking step further comprises:

striking said surface against said tube.

5. The method of claim 1, further comprising the step of:

providing a percussion block having a plurality of selectable surfaces, each of said selectable surfaces having a material affixed thereto against which said percussion instrument is struck to produce said musical tone.

6. The method of claim 1, wherein said tube comprises a cap having a ridge on an inner wall, to enclose one open end of said tube.

7. The method of claim 1, wherein said tube comprises at least one aperture formed through a wall thereof.

8. The method of claim 1, wherein said tube comprises a cap affixed to one of said two open ends of said tube.

9. The method of claim 1, wherein said tube is made of a material selected from the group including cellulose acetate butyrate, polycarbonate, and polyethylene.

10. The method of claim 1, wherein the step of providing a tube comprises the steps of:

providing a first tube having a first selected diameter and length; and providing a second tube having a diameter that is less than that of said first tube, wherein said second tube is placed at least partially within said first tube.

11. The method of claim 1, wherein said tube itself also produces a musical tone in addition to the sound waves that result when mechanical energy is imparted to said column of air, such that complex musical tones are produced.

12. The method of claim 10, wherein said first tube and said second tube are each comprised of different materials.

13. The method of claim 1, wherein said tube has a wall thickness from 0.02 inches to 0.032 inches.

14. The method of claim 1, wherein the step of providing a tube comprises providing a plurality of tubes having different pitches.

* * * * *